United States Patent [19]

Wiegand

[11] Patent Number: 4,750,450

[45] Date of Patent: Jun. 14, 1988

[54] APPARATUS FOR MARKING SURFACES OR OBJECTS

[75] Inventor: Fritz Wiegand, Daisendorf, Fed. Rep. of Germany

[73] Assignee: Dr. F. Diehl & Co. Inh. Fritz Wiegand, Daisendorf, Fed. Rep. of Germany

[21] Appl. No.: 14,402

[22] Filed: Feb. 13, 1987

Related U.S. Application Data

[63] Continuation of Ser. No. 729,676, May 2, 1985, abandoned.

[51] Int. Cl.[4] ..... G09F 17/00; G08B 1/00

[52] U.S. Cl. ..... 116/209; 116/173

[58] Field of Search ..... 116/209, 210, 211, 203, 116/173–175, 28 R; 52/103, 104; 248/511, 519, 530, 532, 533, 537; 40/584, 600, 603, 604, 606, 607, 608, 621; 24/7, 537, 584, 652; 135/38, 39, 33 R, 34; 73/82, 84, 85; D3/2, 5, 10, 12, 13

[56] References Cited

U.S. PATENT DOCUMENTS

| | | | |
|---|---|---|---|
| 827,350 | 7/1906 | Crofford | 116/210 |
| 1,748,874 | 2/1930 | Fentress | 116/210 |
| 2,437,444 | 3/1948 | Srofe | 116/173 |
| 2,521,496 | 9/1950 | Worhun | 116/173 |
| 2,629,115 | 2/1953 | Hansen | 116/210 |
| 2,732,823 | 1/1956 | Hanson | 116/175 |
| 3,091,215 | 5/1963 | Kenmore | 116/173 |
| 3,210,990 | 10/1965 | Cantrell | 116/210 |
| 3,476,929 | 11/1969 | Klinger | 116/173 |
| 3,670,438 | 6/1972 | Carroll et al. | 116/28 R |
| 3,895,348 | 7/1975 | Palermo | 116/173 |
| 3,997,993 | 12/1976 | Flaherty | 116/174 |
| 4,028,827 | 6/1977 | Hufton | 116/173 |
| 4,040,194 | 8/1977 | Penton et al. | 40/621 |
| 4,108,311 | 8/1978 | McClendon | 116/173 |
| 4,185,582 | 1/1980 | Bryant | 116/210 |
| 4,258,493 | 3/1981 | Kettlestrings et al. | 40/600 |
| 4,583,482 | 4/1986 | Smith | 116/173 |

FOREIGN PATENT DOCUMENTS

| | | | |
|---|---|---|---|
| 328624 | 4/1958 | Switzerland | 40/608 |

*Primary Examiner*—William A. Cuchlinski, Jr.
*Assistant Examiner*—Patrick R. Scanlon
*Attorney, Agent, or Firm*—Bachman & LaPointe

[57] ABSTRACT

An apparatus for marking a contaminated area comprising a support tube having on one end thereof a device for supporting the tube upright and at a distance spaced from the device with a signal element.

9 Claims, 1 Drawing Sheet

Fig.1
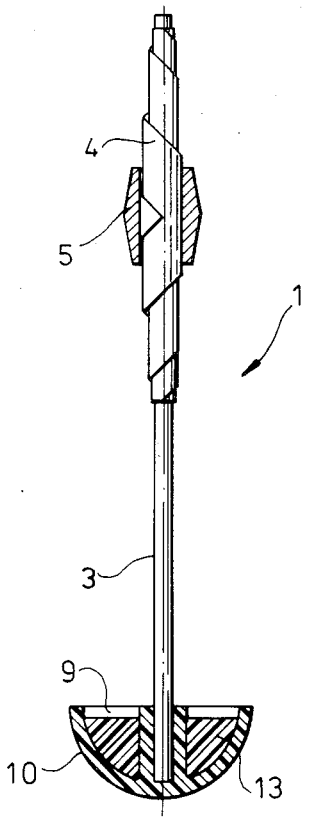
Fig.2
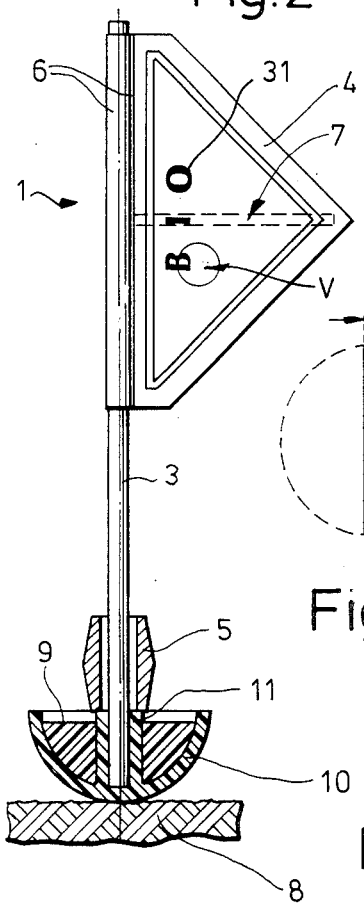
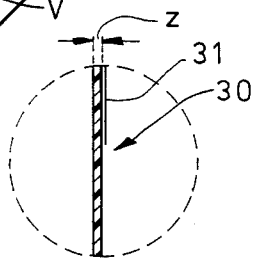
Fig.5
Fig.6
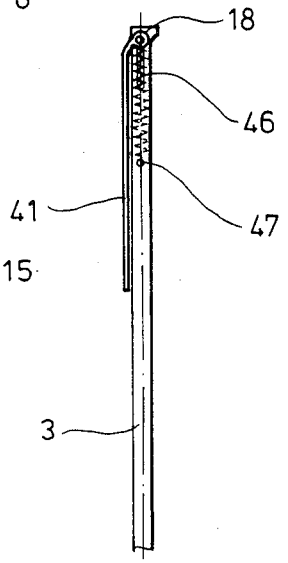
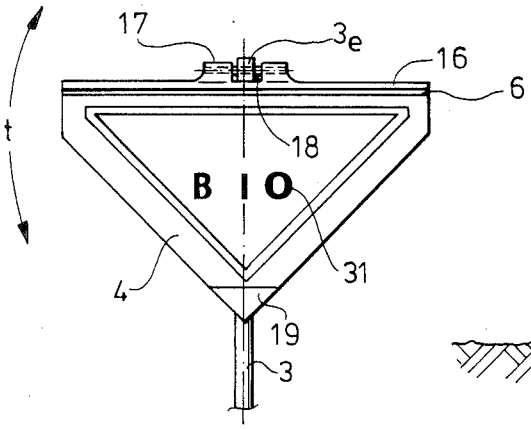
Fig.3
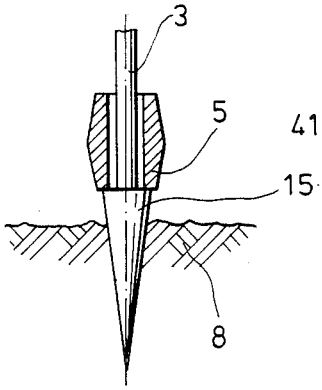
Fig.4

APPARATUS FOR MARKING SURFACES OR OBJECTS

This is a continuation of application Ser. No. 729,676, filed May 2, 1985, and now abandoned.

BACKGROUND OF THE INVENTION

The present invention relates to an apparatus for marking a contaminated area or the like with a signal element set on a support tube and provided with warning symbols.

Such apparatuses are perhaps pennants for delimiting sections of terrain and are stuck there with a shaft end in the ground. A pennant is then located at the upper end of the shaft, to indicate the marking point more clearly. Such pennants are also known with warning expressions of various kinds.

Knowing these circumstances, the inventor set himself the task of creating a marking apparatus which enables contaminated regions to be marked from the air without having to be entered on foot. This apparatus is both to be manipulated without problems and also to be easily stored, and to be suitable for different circumstances. In particular, it is the object of the invention to improve the manipulability and also the availability of the pennant.

SUMMARY OF THE INVENTION

The foregoing object is solved by making the pennant a foil pennant, and connected to the support pipe by a permanent magnet strip. It is also within the scope of the invention for the foil pennant to have a polyester foil which can be rolled up, or a retroreflecting foil of a thickness of 0.1–0.45 mm, or for it to consist of a phosphorescent or fluorescent luminous foil of low thickness.

It has been found to be favorable here to print the luminous foil or even the polyester foil with retroreflecting symbols, for example, with the warning expressions, "ATOM", "BIO", "GAS", "MINES". The warning notices are thus of particular optical intensity and visible for a considerable distance.

Since the foil pennant according to the invention is provided with at least one magnetic strip, it remains easily manipulable and can also be released without difficulty from the support pipe. This needs a steel core as a counter-magnet and is preferably produced as an aluminum tube with a thin-walled steel tube pressed into it.

According to a further feature of the invention, the triangular foil pennant is provided, both on its hypotenuse and also at the vertex opposite this, with a magnetic inlay, which is of particular importance when the foil pennant is to be fixed by this corner on the support tube to reach its stretched position.

The attachment of the magnetic strip to the foil pennant is effected by adhesion, welding or pressing. For example, a resilient yoke can be utilized to hold this magnetic strip.

The foil pennant is easily rolled up, and stored and transported in large numbers in the usual roll-up containers, to be joinable onto the support tube immediately before being ejected from the aircraft or the like.

A good position of the foil pennant is in particular achieved when the support tube ends in a foot part, occupying the center of gravity of the whole signal element; the foot part is either a heavy metal point, which then penetrates into the ground in a known manner, or a synclastically curved surface, preferably a spherical half shell. When the apparatus is ejected from an aircraft, the support tube inserted into the spherical half shell automatically straightens, under the influence of gravity, into the signal or use position and thus does not need correction by human hand.

The spherical half shell preferably consists of impact-resistant material, principally of nylon 66, which is filled with cast lead or the like weighting metal, which has plastic cast over it.

Both this heavy metal tip and also the spherical half shell are coupled to the support tube by a plug connection, and can thus be released from the latter without difficulty.

The releasable connection between the foot part and the support tube mainly serves for adaptation to the requirements at any given time, but also for storage, which is already very advantageous per se with the foil pennant according to the invention.

It has been found to be advantageous if the pennant, rolled up around the shaft in the inoperative position, unrolls under the action of at least one leaf spring; this leaf spring can be wound with the pennant around the holding tube in the inoperative position, and can be fixed there, for example, by the said magnetic corner of the foil pennant.

The said leaf spring can also be fitted radially on the support tube, so that the pennant is laterally stretched; in this case it is particularly simple to fix the foil pennant to the leaf spring by means of the magnetic strip.

Further advantages, features and characteristics of the invention will be gathered from the following description of examples of preferred embodiments and also with reference to the drawings.

BRIEF DESCRIPTION OF THE DRAWINGS

FIG. 1 shows a side view of a marking apparatus in partially sectioned inoperative position;

FIG. 2 shows the marking apparatus of FIG. 1 in the use position;

FIG. 3 shows a part of another marking apparatus in inoperative position, in front view;

FIG. 4 shows a sectioned detail of another embodiment;

FIG. 5 shows an enlarged cross section of the detail of FIG. 2 according to its area V which is enlarged; and FIG. 6 shows parts of FIG. 3 in side view.

DETAILED DESCRIPTION

A marking apparatus 1, principally for marking terrain, plant, and the like which are contaminated radioactively, by biological weapons, or with poison gas, has a triangular pennant 4 at one end of the shaft embodied as the support tube 3; in FIG. 1, the pennant 4 is wound, in its inoperative position, about the support tube 3 and is surrounded by a holding ring 5. A magnetic strip 6 is pressed, welded or adhered into the pennant 4 on its hypotenuse and connects the pennant 4 to the counter-magnetic support tube 3.

Due to the a spring 7 incorporated in the pennant 4 and rolled up in the inoperative position, the pennant 4 unrolls according to FIG. 2 when, after the marking apparatus 1 has struck an obstacle 8, the holding ring 5 has fallen downward from the rolled-up pennant.

Instead of the slidable holding ring 5, one of brittle rupturable material can be used; it breaks, and thus releases the pennant 4, when the marking apparatus 1 hits.

The support tube 3 of the marking apparatus 1 is seated in a concave foot 9, which is made from a spherical half shell 10 with a tube stump 11 internally molded on as a coupling part for the support tube 3. The remaining concave space is filled with weighting material 13, principally cast lead. This concave foot 9 enables the marking apparatus 1 to be thrown out of an aircraft, for example, and in fact even where the ground would not permit penetration of a point 15 (FIG. 4), which can be used as an alternative to the concave foot 9 and can be coupled to the support tube 3 in the manner described. Due to the weighting property of the concave foot 9, the marking apparatus always seats on this, after which the support tube 3 swings into the vertical position.

The point 15 is a hollow spike of forged steel, in which a friction bushing (not shown) of plastic is mounted in the manner of a releasable hose seal, to receive the support tube 3 of light alloy.

The spherical half shell 10 consists of impact-resistant plastic (nylon 66) and is cast with the weighting material 13 (in special cases activated with Pm-147 or C-14) and also with plastic (UP/polyester).

The pennant 4 can also be fixed to a crossbar 16 in the manner described; the latter is jointed by two hinge flaps 17 and a hinge bolt 18 to the shaft end $3_e$ flanked by those hinge flaps 17, but can also, not shown, be pivotable in the direction of the arrow t.

A triangular permanent magnet inlay 19 is provided at the lower end of the pennant and holds the pennant 4, secure against fluttering, on the support tube 3.

The foil material of the symbol foil 30, of thickness Z between 0.1 and 0.45 mm, for the pennant 4, or as a coating for the marker shield 16, is a polyester foil, a phosphorescent luminous foil, or a fluorescent luminous foil with retroreflecting, e.g., containing so-called ballotini glass beads, symbols 31 or symbols (ATOM; GAS; MINES; BIO) in normal printing. A retroreflecting reflex foil with normal symbol printing can also be utilized.

For the sake of clarity, it is not shown in the drawing that the support tube 3 consists of an aluminum profile with an inserted iron tube as core.

FIG. 6 shows the upper part of a support tube 3, with rigid marking shield 41, pivotable about the hinge bolt 18. A coil spring 46 is stretched, as a force accumulator in the interior of the tube, between the hinge bolt 18 and a retaining pin 47 crossing the support tube 3.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A signalling or marking apparatus constructed and arranged as a ballasted projectile comprising:

a support tube terminating at one end in a weight means and at the opposite end in a signal element defining a flexible pennant, said pennant having an inoperative or furled position and an operative or unfurled position, spring means cooperating directly with said pennant for converting said pennant from the furled position to the unfurled position, and, movable pennant retention means in direct contact with said pennant responsive to impact of said weight means for retaining said pennant releasably in said furled position and for activating said spring means upon impact whereby said pennant assumes said unfurled position.

2. The apparatus of claim 1 in which said movable pennant retention means defines a ring surrounding said pennant in the furled position.

3. The apparatus of claim 2 in which the pennant is furled about the support tube and the ring surrounds the support tube and the furled pennant.

4. The apparatus of claim 1 in which the spring means defines a leaf spring.

5. The apparatus of claim 4 in which the leaf spring is incorporated in the pennant and is disposed generally perpendicular to the support tube.

6. The apparatus of claim 2 in which the ring surrounds the support tube and the furled pennant in the region of said spring means.

7. The apparatus of claim 6 in which the ring is held frictionally and movably in the region of said spring means by virtue of the tendency of the furled pennant to unfurl as a result of the bias provided by the spring means.

8. The apparatus of claim 7 in which the ring is operative to overcome friction and slide along the support tube upon impact.

9. A signaling or marking apparatus constructed and arranged as a ballasted projectile comprising:

a support tube terminating at one end in a weight means and at the opposite end in a signal element defining a flexible pennant, said pennant having an inoperative position and an operative position, said pennant being capable of being rolled to define said inoperative position, spring means cooperating with said pennant and rolled with said pennant for converting said pennant from the inoperative position to the operative position, and a ring cooperating with said spring means responsive to impact of said weight means for activating said spring means whereby said pennant unrolls and assumes said operative position.

* * * * *